United States Patent [19]

Wurscher

[11] Patent Number: 4,574,528

[45] Date of Patent: Mar. 11, 1986

[54] APPARATUS FOR GRINDING TWIST DRILLS

[75] Inventor: Raimund A. Wurscher, Vienna, Austria

[73] Assignee: Intermedium AG, Kussnacht am Rigi, Switzerland

[21] Appl. No.: 700,508

[22] Filed: Feb. 11, 1985

[30] Foreign Application Priority Data

Feb. 14, 1984 [AT] Austria ..... 463/84

[51] Int. Cl.[4] ..... B24B 7/00

[52] U.S. Cl. ..... 51/128; 51/5 D; 51/73 R; 51/102; 51/219 R

[58] Field of Search ..... 51/128, 102, 73 R, 5 D, 51/219 R

[56] References Cited

U.S. PATENT DOCUMENTS

| | | | |
|---|---|---|---|
| 3,742,652 | 7/1973 | Enders | 51/128 |
| 3,753,320 | 8/1973 | Wurscher | 51/102 |
| 4,016,680 | 4/1977 | Moores et al. | 51/5 D |

*Primary Examiner*—Frederick R. Schmidt
*Assistant Examiner*—J. T. Zatarga
*Attorney, Agent, or Firm*—Kurt Kelman

[57] ABSTRACT

Apparatus for grinding twist drills comprises a drive shaft and a grinding wheel, which is coupled to said shaft and is mounted thereon to be axially movable relative to the shaft and is spring-loaded toward a drill-guiding structure facing the grinding surface of the grinding wheel. The drill-guiding structure comprises guiding passages for guiding drills differing in diameter against the grinding surface and in association with each guiding passage comprises at least one guide lug for extending into a flute of the twist drill extending through the associated guiding passage, and a drill stop for limiting the advance of the twist drill in the guiding passage against the elastically yielding grinding wheel. To said drill-guiding structure at least one abutment is connected which is engageable by the grinding wheel and has a higher hardness than the grinding wheel. That abutment has an abutment surface which is parallel to the grinding surface of the grinding wheel and is engageable by said grinding surface to limit the displacement of the grinding surface toward the drill-guiding structure under spring force in an end position in which the grinding surface is closer to the guide lugs than the drill stop. The provision of said abutment ensures that the wear of the grinding wheel will not change the position of the grinding wheel relative to the drill-guiding structure and that the grinding surface will be restored substantially to its original shape when the grinding surface has been subjected to irregular wear.

6 Claims, 8 Drawing Figures

FIG. 2
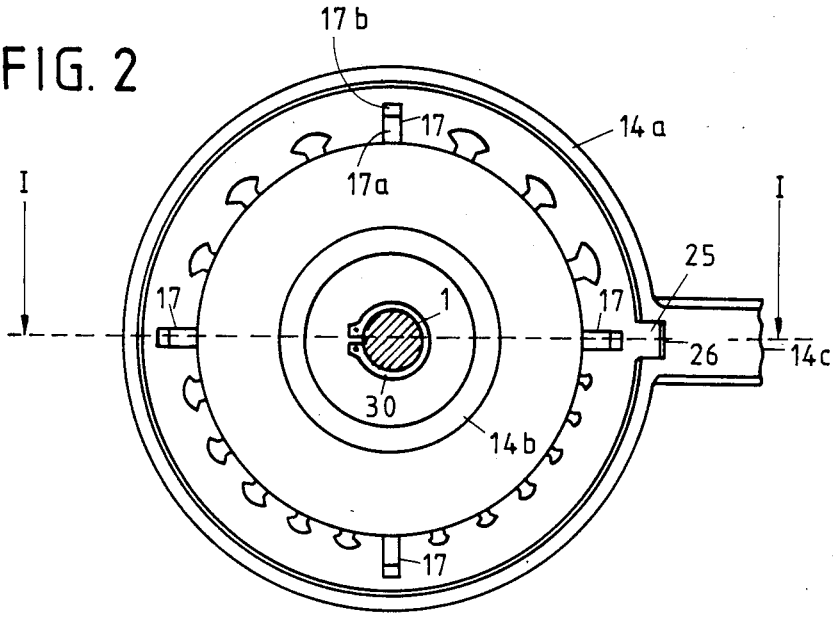
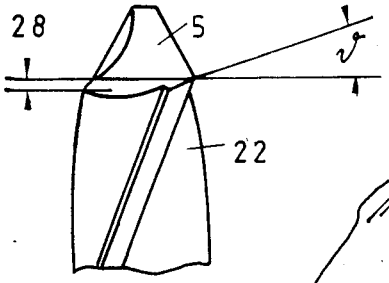
FIG. 4
FIG. 3
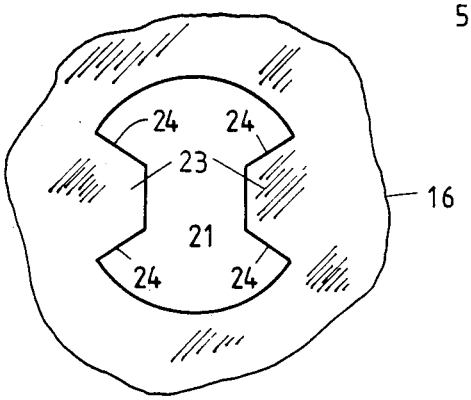
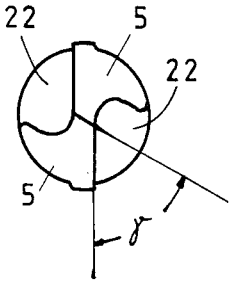
FIG. 5

APPARATUS FOR GRINDING TWIST DRILLS

BACKGROUND OF THE INVENTION

1. Field of the Invention

This invention relates to apparatus for grinding twist drills each having two clearance surfaces and a helical flute associated with each clearance surface, which apparatus comprises a rotatable drive shaft, a grinding wheel having a grinding surface and axially movably mounted on and coupled to said drive shaft and spring biased toward a drill-guiding structure, which faces said grinding surface and has guiding passages differing in diameter and adapted to guide respective ones of said twist drills differing in diameter toward said grinding surface until the latter engages such twist drill at one clearance surface thereof, also comprising in alignment with each of said guiding passages at least one guide projection for extending into a flute of a twist drill extending through said guiding passage, and drill stop means for engaging a twist drill extending through said guiding passage at the other clearance surface thereof so as to limit the advance of said twist drill toward the resiliently yielding grinding surface.

2. Description of the Prior Art

Such apparatus in which twist drills can be ground without being chucked are known from U.S. Pat. No. 3,753,320 and Published German Application No. 16 52 239.

In such known apparatus an adjustable abutment acting between a member rigidly connected to the mounting for the grinding wheel and the drill-guiding structure is arranged to limit the spring-urged movement of the grinding surface toward the drill-guiding structure in an end position in which said grinding surface is closer to the guide projections than the drill stop means.

For a satisfactory result of the grinding operation, a proper position of the clearance surface at which the drill is being ground relative to the grinding surface is of crucial significance. That position will depend on the radial position of the guide projection relative to the guiding passage and, owing to the helical flutes of the twist drill, on the distance from the guide projection to the drill stop means. That distance must be short because otherwise the fact that the flutes of twist drills from different manufacturers have different helix angles will result in an excessive deviation from the proper position of the clearance surface of some of such twist drills relative to the grinding surface.

One disadvantage of said known apparatus resides in that the axial distance from the grinding surface to the guide projections increases with the wear of said grinding surface and eventually the drills may no longer contact the grinding wheel at all. The proper distance must then be reestablished by means of the adjustable abutment means. Owing to the short axial distance between the guide projections and the drill stop means, a wrong adjustment of said drill abutment means may have the result that the grinding wheel grinds on the drill-guiding structure and damages the guide projections.

Another disadvantage of such known apparatus will arise during a prolonged grinding of twist drills which are so small in diameter that they will not contact the entire grinding surface during each revolution of the grinding wheel and resides in that a groove will then be formed in the grinding surface. When a twist drill larger in a diameter is subsequently ground, that groove will be reflected by the clearance surface that has been ground, i.e. by the cutting edge of such larger drill, and the grinding wheel cannot be used any longer when such groove has reached a certain size.

SUMMARY OF THE INVENTION

It is an object of the invention to provide apparatus which is of the kind described first hereinbefore and in which the proper distance between the grinding surface and the guide projections and the original shape of the grinding surface will be automatically maintained and damage to the guide projections by the grinding wheel will be precluded.

In accordance with the invention this object is accomplished in that the grinding wheel has associated with it at least one abutment which is made of a material that has a higher hardness than the grinding wheel, e.g., of a hard metal or cermet, such as cemented carbides, and said abutment is located in the drill-guiding structure and has an abutment surface that is parallel to and engageable by the grinding surface and arranged to limit the spring-urged movement of the grinding surface in an end position in which said grinding surface is closer to the guide projections than the drill stop means.

In such apparatus the axial distance between each guide projections and the grinding surface will remain constant in spite of the wear of the grinding wheel and damage to the guide projections by the grinding wheel will be precluded.

Moreover, whenever a twist drill is retracted from the drill stop means, the rotating grinding wheel will be urged by spring force against the abutment so that the grinding wheel will be worn in contact with said abutment and its grinding surface will assume a shape which conforms to the abutment. In dependence on the time of such wear, the grinding surface will be more or less restored to its original shape if the abutment is at least as wide as the grinding surface. In view of the above, a further object of the invention is to provide apparatus which is of the kind described first hereinbefore and in which means are provided for restoring the grinding surface of a rotating grinding wheel to a desired shape when the twist drill has been retracted from the drill stop means but also when a twist drill is being ground so that the desired shape of the grinding surface will be continuously maintained.

This object is accomplished in that a plurality of abutments engageable by the grinding surface are rigidly connected to the drill-guiding structure and are spaced apart in the peripheral direction of the grinding surface and the grinding wheel is mounted on said shaft so as to be axially movable and tiltable relative to said shaft.

In such apparatus that clearance surface of a drill being ground which does not engage the drill stop means will be forced against the guiding surface so that the spring-biased grinding wheel will be clear of that abutment which is closest to the twist drill but the grinding wheel will still be forced by the spring against the abutment which is diametrically opposite to the drill so that the grinding surface will be continuously restored to the desired shape during the grinding of a twist drill.

In apparatus comprising a grinding wheel carrier, which is rigidly connected to the grinding wheel and has a bore that is coaxial to the grinding wheel, a tiltable mounting of a grinding wheel which will be maintained in a highly accurately centered position will be permitted if, within the scope of the invention, the grinding wheel carrier has only a small thickness adjacent to said bore and the shaft is slightly smaller in diameter than said bore. In such apparatus the transmission of rotation from the shaft to the grinding wheel will be ensured in conjunction with the maintenance of a highly accurately centered position of the grinding wheel if at least one coupling arm is non-rotatably connected to and extends approximately parallel to the shaft and with an angular play into an eccentric opening in the grinding wheel carrier.

It might be criticized that the abutments will blunt the abrasive particles in the grinding surface so that their abrasive action will be decreased. In fact, it can be shown that such blunting will take place quickly. But it can also be shown that such blunted grinding surface will soon be resharpened when it is used to grind without contacting such abutments.

Within the scope of the invention the grinding surface can be resharpened during grinding if the radial dimensions of the grinding surface and of the abutment surfaces are larger than is required for the grinding of the largest twist drill which can be received by any guiding passage of the apparatus and said radial dimensions are so large that the contact pressure between the radially enlarged portions of the grinding surface and of the abutment surfaces is lower than the contact pressure between the clearance surface at which a twist drill is being ground and the grinding surface which is spring-urged against said clearance surface.

In such apparatus that portion of the grinding surface which is contacted by the twist drill being ground will be worn out faster than the remaining portions of the grinding surface and will thus be clear of the abutments and will be sharpened and will remain sharp as the grinding continues. It has been shown that the deformation of the grinding surface resulting during such operation will be negligible if the dimensions of said radially enlarged portions are properly selected and will hardly affect the result of the grinding.

The abutments will usually be made of hard metal or cermets, such as cemented carbides. Hard metal or cermets will suffer only a negligibly small wear in contact with grinding wheels made of alumina, such as are usually employed to grind twist drills of the kind discussed here.

Experience has shown that even a relatively small difference in abrasive hardness between the hard metal and the abrasive particles of the grinding wheel will provide a satisfactory ratio of the wear of the grinding wheel and the wear of the abutments. In general, the abutments must be made of a material which has a higher hardness than the grinding wheel, the hardness of the grinding wheel being the strength with which the binding agent retains the abrasive particles in the grinding surface.

The abutments may be made of materials other than hard metal or cermets, for instance, from polycrystalline diamond (milligrain diamond) or from cubic boron nitride (CBN). Abutments made of such material may be used with grinding wheels incorporating abrasive materials which are harder than alumina, such as silicon carbide.

BRIEF DESCRIPTION OF THE DRAWING

FIG. 2 is a top plan view taken in the direction of the arrow A in FIG. 1 and showing the grill-guiding structure.

FIG. 3 is an enlarged view showing a pair of guide lugs.

FIG. 4 shows the tip portion of a conventional twist drill.

FIG. 5 is a top plan view showing the twist drill tip portion of FIG. 4.

DETAILED DESCRIPTION OF THE PREFERRED EMBODIMENT

Figure 1:
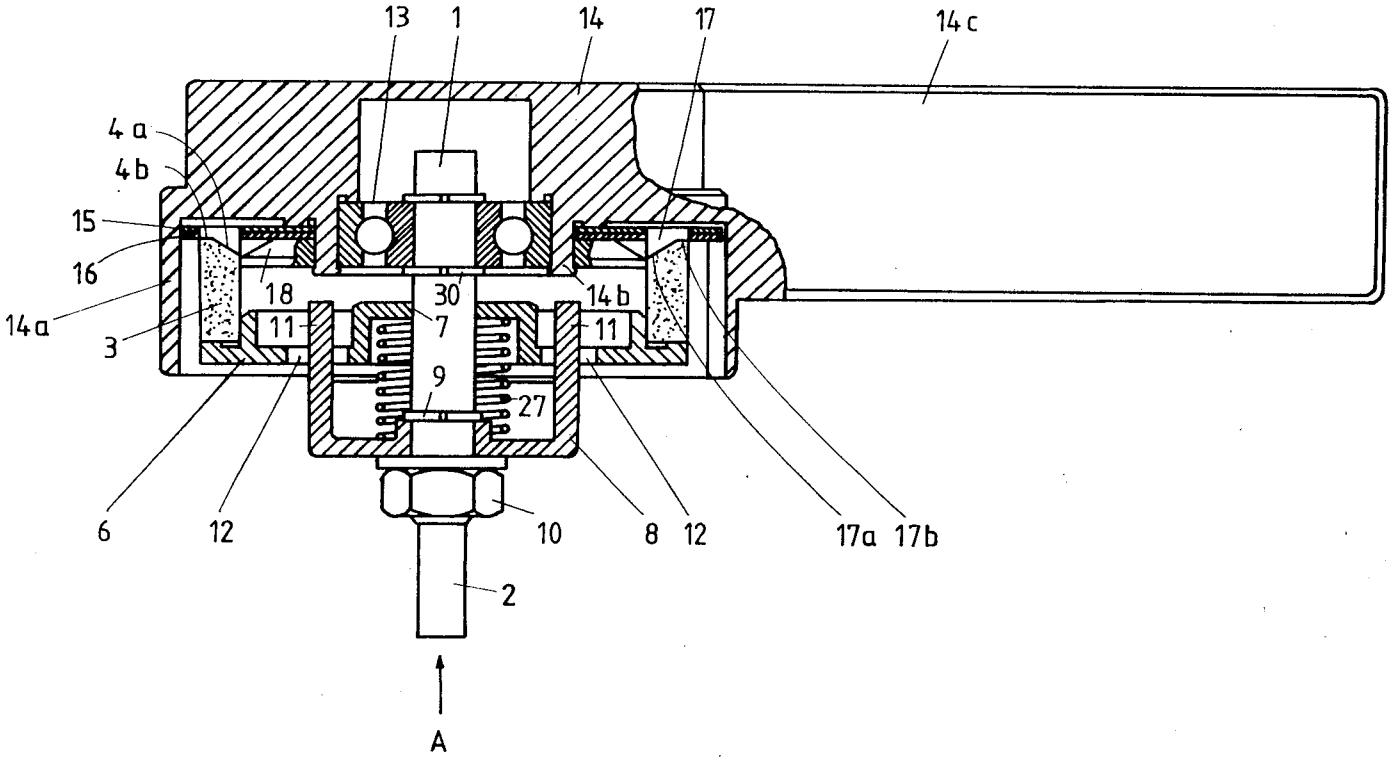
FIG. 1 is a longitudinal sectional view taken on plane I—I' in FIG. 2 and showing apparatus embodying the invention.

An illustrative embodiment of the invention will now be described in more detail with reference to the drawing.

With reference to the drawing, a drive shaft 1 has an extension pin 2, which is adapted to be gripped in the chuck of a drilling machine, not shown.

A hollow grinding wheel 3 has an inside surface comprising a cylindrical surface and a grinding surface. The grinding surface comprises an annular grinding surface portion 4*a*, which corresponds to an imaginary surface in which said cylindrical surface is intersected by an imaginary cone that is coaxial to the cylindrical surface. That grinding surface portion 4*a* has a radial width that is as large as or slightly larger than the radial width of the clearance surface 5 of the largest twist drill that can be received by any of the guiding passages of the drill-guiding structure, which will be described hereinafter. The grinding surface portion 4*a* is adjoined on the outside by an annular grinding surface portion 4*b*, which extends at right angles to the cylindrical surface.

The grinding wheel 3 is adhesively bonded to a grinding wheel carrier 6, which has a bore 7 that is coaxial to the grinding wheel and in the present embodiment has only a small axial length as the grinding wheel carrier has only a small axial dimension. The shaft 1 extends through the bore 7 and is only slightly smaller in diameter than the bore 7 so that the grinding wheel 3 is mounted on the shaft 1 to be axially movable and tiltable relative to the shaft 1.

A coupling element 8, 11 comprises a cup-shaped member 8 having central bore through which the shaft 1 extends. The member 8 is secured to the shaft 1 by being gripped between a retaining ring 9 and a nut 10. The retaining ring is secured to the shaft 1 and the nut is in threaded engagement with mating screw threads on the shaft 1. The coupling element also comprises two coupling arms 11, which protrude upwardly from the rim of the cup and are parallel to the shaft and extend with play through respective eccentric openings 12 in the grinding wheel carrier 6.

The drive shaft 1 is rotatably mounted by means of a ball bearing assembly 13 in a drill-guiding structure comprising rigidly interconnected elements 14 to 18.

Figure 6:
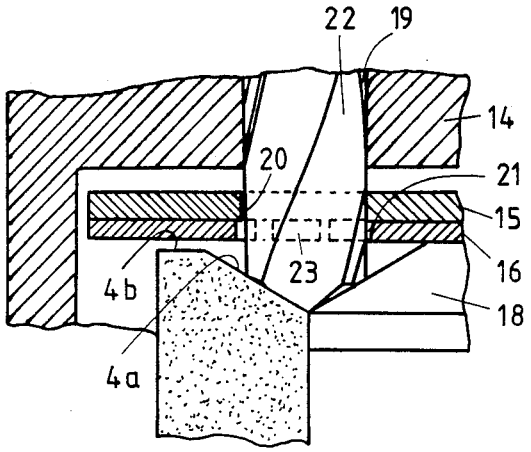
FIG. 6 is an enlarged fragmentary longitudinal sectional view showing respective portions of the drill-guiding structure and grinding wheel of apparatus as shown in FIG. 1, adjacent to one guiding passage, and also shows a twist drill that has been inserted through said guiding passage and is being forced against the drill stop means.
Figure 7:
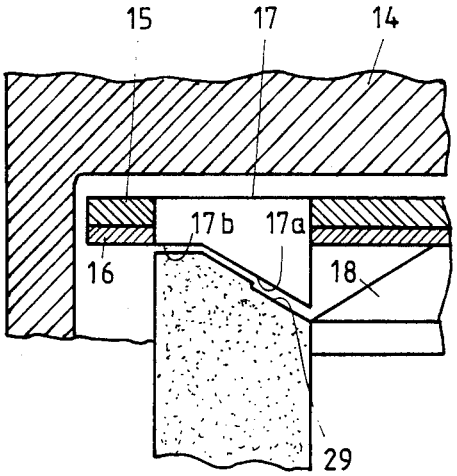
FIG. 7 is a sectional view which is similar to FIG. 6 but shows the structure adjacent to an abutment disposed next to the inserted twist drill.

The element 14 consists of a body formed with cylindrical guiding passages 19 (FIG. 6), which have different diameters and are adapted to guide drills differing in diameter toward the grinding surface 4*a*. The axes of the guiding passages 19 are located in an imaginary cylindrical surface, which is coaxial to the shaft 1 and has a diameter that is approximately as large as the diameter of the cylindrical inside surface of the grinding wheel 3. The body 14 also comprises a hollow-cylindrical extension 14*a*, which surrounds the grinding wheel 3. A handle 14*c* protrudes laterally from the body 14.

A guide lug carrier 15, 16 and a drill stop 18 are interference fits on the hollow-cylindrical extension 14*b* of the body 14.

The guide lug carrier 15, 16 consists of two plates 15 and 16, which are rigidly interconnected. The plate 15 is formed with bores 20, which are aligned with respective guiding passages 19 and are equal in diameter to the corresponding guiding passages 19. The plate 16 has openings 21 aligned with respective bores 20. Two guide lugs 23 (FIG. 3) project into each opening 21 and are arranged to slidably extend with an angular play into respective flutes 22 of a twist drill which extends through the associated guiding passage 19. Each guide lug 23 is formed on opposite radial sides with two edge faces 24 for limiting the rotation in the clockwise and counterclockwise senses of a twist drill that extends through the associated guiding passage 19 and between the guide lugs 23. An additional lug or rib 25 of the guide lug carrier 15, 16 extends outwardly into a mating groove 26 formed in the body 14 to ensure that the openings 20 and 21 of the guide lug carrier 15, 16 will be aligned with respective guiding passages 19 of the body 14 (FIG. 2).

The drill stop 18 is frustoconical and has a conical outside stop face.

Four abutments 17 which are engageable by the grinding wheel 3 are soldered to the guide lug carrier 15, 16 and consist of a material that has a higher abrasive hardness than the grinding wheel 3, particularly of cemented carbides. The abutments 17 face the grinding surface 4*a*, 4*b* and are regularly spaced apart in the peripheral direction thereof (FIGS. 1, 2, 7 and 8). Each abutment 17 is formed with abutment surfaces 17*a* and 17*b*. The abutment surfaces 17*a* face and are parallel to the grinding surface portion 4*a*. The abutment surfaces 17*b* face and are parallel to the grinding surface portion 4*b*. The abutment surfaces 17*a* and 17*b* have a smaller axial spacing from the guide pins 23 than the stop face of the drill stop 18.

A spring 27 bears at one end against the bottom of the coupling element 8, 11 and at its other end against the grinding wheel carrier and urges the grinding surface portions 4*a*, 4*b* of the grinding wheel 3 toward the abutment surfaces 17*a*, 17*b*, respectively, of the abutments 17. In emgagement with the abutments 17, the grinding surface 4*a*, 4*b* will be closer to the guide lugs 23 than the stop face of the drill stop 18.

The embodiment described hereinbefore has the following mode of operation:

The extension pin 2 of the shaft 1 is chucked in the chuck of a hand-held electric drilling machine. The resulting assembly is held by means of one hand at the handle 14*c*. Then the drilling machine is started so that the rotation of the chuck is transmitted by the shaft 1, the coupling element 8, 11 and the grinding wheel carrier 6 to the grinding wheel 3. The twist drill to be ground is pushed with the other hand into the narrowest guiding passage 19 which can receive that drill and is moved to extend between the guide lugs 23 associated with said guiding passage 19 until one clearance surface 5 of said twist drill bears on the drill stop 18. Then the twist drill is caused to perform a plurality of angular oscillations between the edge faces 24 of the guide lugs 23. Thereafter the twist drill is axially retracted from the guide lugs 23 and is then rotated through 180° C. and the procedure described hereinbefore is repeated to grind that clearance surface 5 of the drill which has previously engaged the drill stop 18. The two grinding cycles which have been described hereinbefore may be repeated until the drill has been ground as desired. Thereafter the drilling machine is turned off.

The twist drill has thus been concentrically ground to tolerances which are satisfactory in practice and its clearance surfaces have been ground so that the twist drill has an adequate clearance 28 (FIG. 4), a desired clearance angle $\delta$ (FIG. 4) and a desired chisel edge angle $\gamma$ (FIG. 5). If a larger clearance 28 etc. is desired, the twist drill to be ground will be inserted into the next wider guiding passage 19.

Figure 8:
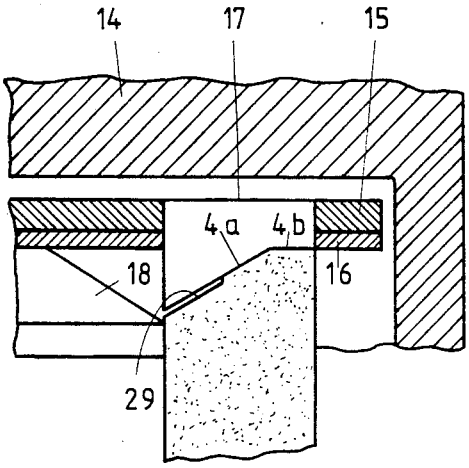
FIG. 8 is a sectional view that is similar to FIG. 6 but shows the structure adjacent to the abutment which is diametrically opposite to the inserted twist drill.

During the grinding operation that clearance surface 5 of the drill which does not bear on the drill stop 18 forces the resiliently yielding grinding wheel 3 away from the nearest adjacent abutment 17 (FIG. 7) while the grinding wheel 3 is still forced by the spring 27 against and will be worn in contact with those abutments 17 which are more or less diametrically opposite to the twist drill being ground (FIG. 8). As a result, the grinding surface 4*a*, 4*b* will be restored to its original shape continuously throughout the grinding operation.

It is also apparent from the drawing that the wear of the grinding wheel 3 will not change the distance from the grinding surface 4*a*, 4*b* to the guide lugs 23 until the grinding wheel carrier 6 engages a stop ring 30 secured to the drive shaft 1. In that case the grinding wheel must be replaced.

A blunting of the abrasive particles of the grinding surface portion 4*a* by the abutments 17 will be prevented if the radial width of the grinding surface portion 4*b* and the area of each abutment surface 17*b* are so selected that the contact pressure between said surfaces 4*b* and 17*b* during the grinding operation will be somewhat lower than the contact pressure between the grinding surface portion 4*a* and the clearance surface 5 of the largest drill which can be received by the apparatus when said drill is forced against the grinding surface portion 4*a* to overcome the force of the spring 27. It has been explained more in detail hereinbefore that in such case that grinding surface portion 4*a* which is in contact with the twist drill will be sharpened during the grinding operation. Whereas this will result in a deformation of the grinding surface portion 4*a* as is indicated in an exaggerated size at 29 in FIGS. 6 to 8, that deformation will hardly be detectable if the radial width of the grinding surface portion 4*b* and the area of the abutment surface 17*b* are properly selected.

An illustrative embodiment of the invention has been described hereinbefore but the invention is by no means restricted to that embodiment. For instance, the illustrative embodiment which has been described is designed as an attachment for a hand-held drilling machine. Alternatively, the invention might be embodied in a self-contained unit which incorporates a motor.

It is believed that a satisfactory result as regards the grinding action of the grinding wheel on the twist drills and as regards the action of the abutments on the grinding surface will be produced by the use of the features of the invention if the grinding surface in contact with the twist drill revolves at a surface speed of about 3 to 30 meters per second and that optimum results will be produced at a surface speed of about 20 meters per second. With a grinding wheel having an outside diameter of about 80 mm, said surface speeds correspond to speeds in the range from about 700 to 7000 r.p.m. or to an optimum speed of 5000 r.p.m.

The embodiments of the invention in which an exclusive property or privilege is claimed are defined as follows:

1. In apparatus for grinding twist drills having two clearance surfaces and two helical flutes associated with respective ones of said clearance surfaces, comprising a rotatable drive shaft, a grinding wheel, which has an annular grinding surface and is mounted on said shaft and axially movable thereon and is coupled to said shaft for rotation thereby, a drill-guiding structure axially spaced apart from said grinding surface, and spring means urging said grinding wheel toward said drill-guiding structure, said drill-guiding structure defining a plurality of peripherally spaced apart guiding passages which are different in diameter and open at one end which is spaced from and faces said grinding surface and at the opposite end and are adapted each to receive a twist drill in a position in which one clearance surface of said twist drill contacts said grinding surface in a portion thereof which is axially aligned with said guiding passage, said drill-guiding structure comprising in axial alignment with each of said guiding passages near said one end thereof at least one guiding projection, which is adapted to extend into one of said flutes of a twist drill extending through said guiding passage, said drill-guiding structure comprising drill stop means which have stop surface portions which are axially aligned with and face respective ones of said guiding passages and are engageable by the other clearance surface of a twist drill extending through the associated guiding passage to limit the advance of said twist drill toward said grinding surface, the improvement residing in that the grinding wheel has associated with it at least one abutment which is made of a material that has a higher hardness than the grinding wheel, e.g., of a hard metal or cermet, such as cemented carbides, and said abutment is located in the drill-guiding structure and has an abutment surface that is parallel to and engageable by the grinding surface and arranged to limit the spring-urged movement of the grinding surface in an end position in which said grinding surface is closer to the guide projections than the drill stop means.

2. The improvement set forth in claim 1, wherein said drill guiding structure comprises a plurality of peripherally spaced apart abutments, each of which is formed with said abutment surface, and said grinding wheel is mounted on said shaft to be tiltable to a position in which said grinding surface is clear of at least one of said abutment surfaces.

3. The improvement set forth in claim 2 as applied to apparatus in which said grinding wheel is carried by and non-rotatably connected to a grinding wheel carrier and is mounted on said drive shaft by means of said grinding wheel carrier and said grinding wheel carrier has a through bore which is coaxial to said grinding wheel, wherein said drive shaft extends through said through bore with a clearance and is coupled to said grinding wheel carrier to rotate the latter.

4. The improvement set forth in claim 3, wherein said grinding wheel carrier has a small axial thickness adjacent to said through bore.

5. The improvement set forth in claim 3, wherein said grinding wheel carrier is formed with at least one eccentric opening, which is generally parallel to said through bore and said drive shaft carries at least one coupling arm, which is non-rotatably connected to and generally parallel to said drive shaft and extends through said opening with play.

6. The improvement set forth in claim 2, wherein the radial dimensions of the grinding surface and of the abutment surfaces are larger than is required for the grinding of the largest twist drill which can be received by any guiding passage of the apparatus and said radial dimensions are so large that the contact pressure between the radially enlarged portions of the grinding surface and of the abutment surfaces is lower than the contact pressure between the clearance surface at which a twist drill is being ground and the grinding surface which is spring-urged against said clearance surface.

* * * * *